US005873953A

United States Patent [19]

Schriever

[11] Patent Number: 5,873,953

[45] Date of Patent: Feb. 23, 1999

[54] NON-CHROMATED OXIDE COATING FOR ALUMINUM SUBSTRATES

[75] Inventor: Matthias P. Schriever, Kent, Wash.

[73] Assignee: The Boeing Company, Seattle, Wash.

[21] Appl. No.: 780,114

[22] Filed: Dec. 26, 1996

[51] Int. Cl.[6] ..... C23C 22/48

[52] U.S. Cl. ..... 148/273; 148/274; 148/275; 148/285; 148/286

[58] Field of Search ..... 148/273, 274, 148/275, 285, 286

[56] References Cited

U.S. PATENT DOCUMENTS

| | | | |
|---|---|---|---|
| 1,551,613 | 9/1925 | Pacz | 148/273 |
| 1,607,676 | 11/1926 | Jirotka | 148/242 |
| 2,796,370 | 6/1957 | Ostrander et al. | 148/268 |
| 2,796,371 | 6/1957 | Ostrander et al. | 148/268 |
| 2,906,009 | 9/1959 | Knoll et al. | 428/626 |
| 3,138,479 | 6/1964 | Foley | 427/129 |
| 3,403,035 | 9/1968 | Schneble et al. | 427/443.1 |
| 3,423,214 | 1/1969 | Koretzky | 106/1.22 |
| 3,438,798 | 4/1969 | Baudrand et al. | 427/304 |

(List continued on next page.)

FOREIGN PATENT DOCUMENTS

| | | | |
|---|---|---|---|
| A-39376/89 | 8/1990 | Australia . | |
| 0356756A1 | 7/1990 | European Pat. Off. . | |
| 405340A1 | 1/1991 | European Pat. Off. . | |
| 458020A1 | 11/1991 | European Pat. Off. . | |
| 0488430A2 | 6/1992 | European Pat. Off. . | |
| 0523288A1 | 6/1993 | European Pat. Off. . | |
| 745704 | 11/1944 | Germany . | |
| 61-238979 | 10/1986 | Japan | 148/286 |
| 953987 | 4/1964 | United Kingdom . | |

(List continued on next page.)

OTHER PUBLICATIONS

"Deposition of Nickel and Cobalt by Chemical Reduction," Brenner & Riddel, *J. of Research of the National Bureau of Standards,* pp. 385–395, vol. 39, Nov. 1947.

"Nickel and Cobalt Films" by Samuel Wein; *The Glass Industry,* pp. 22, 23, 35, and 46, Jan. 1960.

"Regulating Coercivity of Magnetic Thin Films," Tsu & Sakamoto, *IBM Tech. Discl. Bull.,* pp. 52–53, vol. 4, No. 8, Jan. 1962.

A. Martell and M. Calvin, *Chemistry Of The Metal Chelate Compounds,* pp. 1–18 (Prentice–Hall 1952).

(List continued on next page.)

*Primary Examiner*—David A. Simmons
*Assistant Examiner*—Robert R. Koehler
*Attorney, Agent, or Firm*—Paul C. Cullom, Jr.

[57] ABSTRACT

An improved process that is commercially practical for forming an oxide film cobalt conversion coating exhibiting corrosion resistance and paint adhesion properties on an aluminum or aluminum alloy substrate (for example, aerospace and aircraft parts), the process including the steps of: (a) providing an oxide film forming cobalt conversion solution including an aqueous reaction solution, containing no triethanolamine (TEA), prepared by reacting the following starting materials: (1) a water soluble cobalt-II salt; (2) a water soluble ammonium salt; (3) a water soluble inorganic complexing agent selected from the group consisting of water soluble metal nitrites; (4) a water soluble organic complexing agent; and (5) a water soluble oxidizing agent; and (b) contacting the aluminum or aluminum alloy substrate with the aqueous reaction solution for a sufficient amount of time to oxidize the surface of the substrate, whereby the oxide film cobalt conversion coating is formed, thereby imparting corrosion resistance and paint adhesion properties to the substrate. Also an improved chemical conversion coating solution that is commercially practical for producing an oxide film cobalt conversion coating on a metal substrate, said solution comprising an aqueous reaction solution, containing no triethanolamine (TEA), prepared by reacting the following starting materials: (1) a water soluble cobalt-II salt; (2) a water soluble ammonium salt; (3) a water soluble inorganic complexing agent selected from the group consisting of water soluble metal nitrites; (4) a water soluble organic complexing agent; and (5) a water soluble oxidizing agent.

12 Claims, 3 Drawing Sheets

U.S. PATENT DOCUMENTS

| | | | |
|---|---|---|---|
| 3,444,007 | 5/1969 | Maurer et al. | 148/273 |
| 3,592,747 | 7/1971 | Cohn | 148/279 |
| 3,615,740 | 10/1971 | Goltz | 106/14.11 |
| 3,790,453 | 2/1974 | Wanamaker et al. | 205/50 |
| 3,819,424 | 6/1974 | Russell et al. | 148/261 |
| 3,870,607 | 3/1975 | Bardach | 205/122 |
| 3,877,981 | 4/1975 | Arnold | 427/305 |
| 3,905,838 | 9/1975 | Ito | 148/6.27 |
| 3,928,237 | 12/1975 | Davis | 502/313 |
| 3,954,510 | 5/1976 | Gunn et al. | 148/6.2 |
| 3,993,510 | 11/1976 | Bellavin | 148/268 |
| 4,088,486 | 5/1978 | Bissonette | 430/393 |
| 4,150,172 | 4/1979 | Kolk, Jr. | 427/129 |
| 4,208,212 | 6/1980 | Kuzuwata et al. | 148/259 |
| 4,218,240 | 8/1980 | Gingerich et al. | 75/365 |
| 4,233,063 | 11/1980 | Ritsko et al. | 75/374 |
| 4,261,766 | 4/1981 | Crouch | 148/273 |
| 4,278,463 | 7/1981 | Vanderpool et al. | 75/374 |
| 4,278,477 | 7/1981 | Reinhold | 148/6.14 R |
| 4,337,097 | 6/1982 | Tokumasu et al. | 148/261 |
| 4,348,224 | 9/1982 | Gingerich et al. | 75/353 |
| 4,381,203 | 4/1983 | Reinhold | 148/270 |
| 4,392,920 | 7/1983 | McDonald | 205/227 |
| 4,631,093 | 12/1986 | Etemovich | 148/6.1 |
| 4,637,374 | 1/1987 | Arai | 427/383.7 |
| 4,647,347 | 3/1987 | Schoener | 204/37.6 |
| 4,659,605 | 4/1987 | Malik et al. | 427/129 |
| 4,696,724 | 9/1987 | Deguchi et al. | 148/264 |
| 4,804,407 | 2/1989 | Scheithauer et al. | 75/372 |
| 4,897,129 | 1/1990 | Tuttle, Jr. et al. | 148/256 |
| 5,298,092 | 3/1994 | Schriever | 148/275 |
| 5,378,293 | 1/1995 | Schriever | 148/275 |
| 5,411,606 | 5/1995 | Schriever | 148/240 |
| 5,472,524 | 12/1995 | Schriever | 148/273 |
| 5,551,994 | 9/1996 | Schriever | 148/273 |

FOREIGN PATENT DOCUMENTS

| | | |
|---|---|---|
| 1345868 | 2/1974 | United Kingdom . |
| WO 91/11542 | 8/1991 | WIPO . |
| WO 94/00619 | 1/1994 | WIPO . |

OTHER PUBLICATIONS

G. Jander and E. Blasius, Einfuhrung in das anorganisch—chemische Praktikum (1968), pp. 106–107.

Van Nostrand's Scientific Encyclopedia (1983), sixth edition, vol. 1, p. 124, "Ammines".

*Chemical Abstracts,* vol. 89, 1978, abstract No. 122118c, Complexes of Cobalt containing ammonia or ethylenediamine.

M. Munakata, "Some New Oxygenated Cobalt Complexes," *Bulletin of The Chem. Soc. of Japan,* vol. 44, pp. 1791–1796 (1971).

S. Fukuzumi et al., "Activation of Cobalt (III)—Alkyl Bonds . . . ," *Chemistry Letters,* pp. 421–424 (1984).

I. Sasaki et al., "X–Ray And Electrochemical Investigation Of A Series Of Cobalt . . . , " *Polyhedron,* vol. 6, pp. 2103–2110 (1987).

W. Fernelius ed., "69. Hexamminecobalt(II) Salts," *Inorganic Syntheses,* first edition, vol. II, pp. 216–225 (McGraw–Hill 1946).

NON-CHROMATED OXIDE COATING FOR ALUMINUM SUBSTRATES

CROSS-REFERENCE TO RELATED APPLICATIONS

This application is related to the following earlier-filed applications:

U.S. Ser. No. 07/525,800 (application #1), filed May 17, 1990, now U.S. Pat. No. 5,298,092, issued Mar. 29, 1994.

U.S. Ser. No. 08/173,591 (application #1A), filed Dec. 23, 1993, a divisional of Ser. No. 07/525,800 (application #1), now U.S. Pat. No. 5,487,949, issued Jan. 30, 1996.

U.S. Ser. No. 08/173,593 (application #1B), filed Dec. 23, 1993, a divisional of Ser. No. 07/525,800 (application #1), now U.S. Pat. No. 5,415,687, issued May 16, 1995.

U.S. Ser. No. 07/621,132 (patent application #2), filed Nov. 30, 1990 (now abandoned).

U.S. Ser. No. 08/212,654 (application #2A), filed Mar. 11, 1994, a continuation of Ser. No. 07/621,132 (application #2), now U.S. Pat. No. 5,472,524, issued Dec. 5, 1995.

U.S. Ser. No. 07/732,568 (application #3), filed Jul. 19, 1991 (now abandoned).

U.S. Ser. No. 08/058,655 (application #3A), filed May 6, 1993, a continuation of Ser. No. 07/732,568 (application #3), now U.S. Pat. No. 5,378,293, issued Jan. 3, 1995.

U.S. Ser. No. 07/903,853 (application #4), filed Jun. 25, 1992, now U.S. Pat. No. 5,411,606, issued May 2, 1995.

U.S. Ser. No. 08/287,690 (application #5), filed Aug. 9, 1994, now U.S. Pat. No. 5,551,994, issued Sep. 3, 1996.

TECHNICAL FIELD

This environmental-quality invention is in the field of chemical conversion coatings formed on metal substrates, for example, on aluminum and aluminum alloy substrates. For aerospace/aircraft applications (for example, for treating aerospace and aircraft parts), the invention produces conversion coatings exhibiting excellent corrosion resistance performance while maintaining acceptable levels of paint adhesion performance.

BACKGROUND OF THE INVENTION

One aspect of the invention is an improved process of forming an oxide coating, which I refer to as a "cobalt conversion coating," that is chemically formed by oxidizing the surface of a metal substrate, such as an aluminum or aluminum alloy substrate. The invention enhances the quality of the environment of humankind by contributing to the maintenance of air and water quality.

In general, chemical conversion coatings are formed chemically by causing the surface of the metal to be "converted" into a tightly adherent coating, all or part of which consists of an oxidized form of the substrate metal. Chemical conversion coatings can provide high corrosion resistance as well as strong bonding affinity with paint. The industrial application of paint to metals generally requires the use of a chemical conversion coating, particularly when the performance demands are high.

Although aluminum protects itself against corrosion by forming a natural oxide coating, the protection is not complete. In the presence of moisture and electrolytes, aluminum alloys, particularly the high-copper 2000-series aluminum alloys, such as alloy 2024-T3, corrode much more rapidly than pure aluminum.

In general, there are two types of processes for treating aluminum to form a beneficial conversion coating. The first is by anodic oxidation (anodization) in which the aluminum component is immersed in a chemical bath, such as a chromic or sulfuric acid bath, and an electric current is passed through the aluminum component and the chemical bath. The resulting conversion coating on the surface of the aluminum component offers resistance to corrosion and a bonding surface for paint.

The second type of process is by chemically producing a conversion coating, which is commonly referred to as a chemical conversion coating, by subjecting the aluminum component to a chemical solution, such as a chromate solution, but without using an electric current in the process. The chemical solution may be applied by immersion application, by manual application, or by spray application. The resulting conversion coating on the surface of the aluminum component offers resistance to corrosion and a bonding surface for paint. The present invention relates to this second type of process for producing chemical conversion coatings. The chemical solution may be applied by immersion application, by various types of manual application, or by spray application.

One widely used chromate process for forming chemical conversion coatings on aluminum substrates is described in various embodiments in Ostrander et al. U.S. Pat. No. 2,796,370 and Ostrander et al. U.S. Pat. No. 2,796,371, in military process specification MIL-C-5541, and in Boeing Process Specification BAC 5719. These chromate chemical conversion baths contain hexavalent chromium, fluorides, and cyanides, all of which present significant environmental as well as health and safety problems. The constituents of a typical chromate conversion bath, such as ALODINE 1200®, are as follows: $CrO_3$-"chromic acid" (hexavalent chromium); NaF—sodium fluoride; $KBF_4$—potassium tetrafluoroborate; $K_2ZrF_6$—potassium hexafluorozirconate; $K_3Fe(CN)_6$—potassium ferricyanide; and, $HNO_3$—nitric acid (for pH control).

Many aluminum and aluminum alloy structural parts, as well as Cd plated, Zn plated, Zn-Ni plated, and steel parts, throughout the aircraft/aerospace industry are currently being treated using this chromate process technology. Chromate conversion films, as formed on aluminum and aluminum alloy substrates, meet a 168 hours corrosion resistance criterion, but they primarily serve as a surface substrate for paint adhesion. Because of their relative thinness and low coating weights (40–150 milligrams/$ft^2$), chromate conversion coatings do not cause a fatigue life reduction in the aluminum and aluminum alloy structure.

However, environmental regulations in the United States, particularly in California, and in other countries are drastically reducing the allowed levels of hexavalent chromium compounds in effluents and emissions from metal finishing processes. Accordingly, chemical conversion processes employing hexavalent chromium compounds must be replaced. The present invention, which does not employ hexavalent chromium compounds, is intended to replace the previously used chromate process for forming conversion coatings on aluminum and aluminum alloy substrates.

Ito U.S. Pat. No. 3,905,838

Ito U.S. Pat. No. 3,905,838 discloses a bath comprising, as the main liquid, either or both of aqueous hydrogen peroxide solution and aqueous ammonia and additionally incorporating an oxidizing agent, an inhibitor to retard liquid temperature elevation, a stabilizer for solution and, if a heavy metal is present, triethanolamine as a valency stabilizer for said heavy metal, which bath is used for treating the surface of aluminum or an alloy thereof to nonelectrolytically form a colored oxide film on the surface. In addition, Ito discloses a method of forming on the said surface, a colored oxide film by thoroughly washing the surface of the aluminum or an aluminum alloy and subsequently immersing the washed metal in the said bath.

Thus, Ito describes a bath for forming a film of aluminum oxide. The bath contains aqueous ammonia, aqueous hydrogen peroxide, an oxidizing agent (for example, $KBrO_3$ alone or in combination with $(NH_4)_2CO_3$), an inhibitor (for example, KF, $NH_4Cl$, or sorbitol) which is capable of retarding the bath temperature increase and preventing the film of aluminum hydroxide from dissolution, and triethanolamine which functions as a bath stabilizer (see col. 2, line 63—col. 3, line 9). If the bath contains a heavy metal ion, the triethanolamine functions as the valency stabilizer of the heavy metal ion (see col. 3, lines 9–11).

Ito states that when the bath is composed solely of ammonia, an oxidizing agent, hydrogen peroxide, and a heavy metal, the bath is so chemically unstable that if it is allowed to stand in its unaltered form, it will no longer function as desired after several hours of standing (see col. 4, lines 58–64). Ito states further that when such a bath (composed solely of ammonia, an oxidizing agent, hydrogen peroxide, and a heavy metal) is used to treat the aluminum alloy repeatedly, the bath readily undergoes decomposition and becomes unusable in a short period of time (see col. 4, lines 64–67). This is because, if the bath contains the salt of a heavy metal, it has its chemical composition changed by the variation of the valency of the heavy metal such as, for example, $$Co^{++} \xrightarrow{\text{(oxidation)}} Co^{+++}, Fe^{++} \xrightarrow{\text{(oxidation)}} Fe^{+++},$$

$$Cu^{++} \xrightarrow{\text{(reduction)}} Cu^{+}, \text{and } Cr^{VI} \xrightarrow{\text{(reduction)}} Cr^{III}$$

(see col. 4, line 68—col. 5, line 4). To preclude such change of the chemical composition of the bath, Ito incorporates in his bath the aforementioned inhibitor (for example, KF, $NH_4Cl$, or sorbitol) for retarding the bath temperature increase and triethanolamine as a stabilizer serving to prevent possible change of the valency of the heavy metal (see col. 5, lines 4–10).

Example 4 of Ito describes preparing a bath containing 500 cc of 28% 3N $NH_4OH$ solution, 10.0 g of KF, 5.0 g of $NH_4Cl$, 2.5 g of $NH_4F$. HF, 1.2 g of $KBrO_3$, 1.0 g of $(NH_2)_2CS$, 0.7 g of $CoCl_2$, 0.5 g of $CuCl_2$, 0.1 g of sorbitol, and 5 cc of $(HOCH_2CH_2)_3N$ (triethanolamine). $CoCl_2$ is a cobalt-II salt. As described above, Ito uses triethanolamine as a valency stabilizer serving to prevent possible change of the valency of the heavy metal. Thus, the presence of triethanolamine in Example 4 would, presumably, prevent the small amount of cobalt-II salt which is present in the solution from being oxidized and precipitating out of the solution.

Tokumasu et al. U.S. Pat. No. 4,337,097

Tokumasu et al. U.S. Pat. No. 4,337,097 discloses a method for making a selective absorption film for solar energy which comprises immersing aluminum or its alloy in water which contains at least two members selected from phosphate ions, fluoride ions and triethanolamine, and optionally ions of a metal selected from copper, iron, cobalt, silver and a mixture thereof thereby forming a chemical conversion film which shows a great absorptivity and a small emissivity.

SUMMARY OF THE INVENTION

The present invention exhibits certain improvements with respect to the processes described in the earlier related patent applications cross-referenced above: Ser. No. 07/525,800 (patent application #1), Ser. No. 07/621,132 (patent application #2), Ser. No. 07/732,568 (patent application #3), and Ser. No. 07/903,853 (patent application #4). In general, the improvements are, first, improved bath stability and consequently longer bath life, and, second, improved corrosion resistance performance exhibited by the coated aluminum or aluminum alloy substrates.

Regarding the improved bath stability, the bath of the present invention has no detectable decay rate after six months of production use. The decay rate is measured by the sludge formed in the bath. The bath of the present invention has no sludge in the bath after six months of production use. Furthermore, the bath performance effectiveness has not decreased in six months of production use. Another advantage is that the bath constituents are replenishable. A six-month bath life is considered a minimum for a commercially practical service life in the aircraft/aerospace industry. Thus, the present invention is a commercially practical process and a commercially practical bath.

Regarding the improved corrosion resistance performance, coated aluminum alloy substrates made by the improved process exhibit an increased level of corrosion resistance in a standard salt spray test, when tested in accordance with ASTM B117, while also exhibiting technically acceptable levels of paint adhesion when tested in accordance with the tests specified in applicable aircraft/aerospace paint specifications.

In one aspect, the invention is an improved process that is commercially practical for forming an oxide film cobalt conversion coating exhibiting corrosion resistance and paint adhesion properties on an aluminum or aluminum alloy substrate, the process comprising the steps of:

(a) providing an oxide film forming cobalt conversion solution comprising an aqueous reaction solution, containing no triethanolamine (TEA), prepared by reacting the following starting materials:
  (1) a water soluble cobalt-II salt;
  (2) a water soluble ammonium salt;
  (3) a water soluble inorganic complexing agent selected from the group consisting of water soluble metal nitrites;
  (4) a water soluble organic complexing agent; and
  (5) a water soluble oxidizing agent; and (b) contacting the aluminum or aluminum alloy substrate with the aqueous reaction solution for a sufficient amount of time to oxidize the surface of the substrate, whereby the oxide film cobalt conversion coating is formed, thereby imparting corrosion resistance and paint adhesion properties to the substrate.

In another aspect, the invention is a chemical conversion coating solution that is commercially practical for producing an oxide film cobalt conversion coating on an aluminum or aluminum alloy substrate, the solution comprising an aqueous reaction solution, containing no triethanolamine (TEA), prepared by reacting the following starting materials:

(1) a water soluble cobalt-II salt;
(2) a water soluble ammonium salt;
(3) a water soluble inorganic complexing agent selected from the group consisting of water soluble metal nitrites;
(4) a water soluble organic complexing agent; and
(5) a water soluble oxidizing agent.

BRIEF DESCRIPTION OF THE DRAWINGS

The figures are photomicrographs of images produced by a scanning electron microscope of improved cobalt conversion coatings made by the present process on aluminum alloy test panels. Thus, FIGS. 1–6 show cobalt conversion coatings formed by a 30 minute immersion in a typical cobalt coating aqueous reaction solution at 140° F. The cobalt conversion coatings formed by the present improved process are cobalt oxide and aluminum oxide mixed structures formed by oxidizing the surface of the substrate.

FIG. 1 is a photomicrograph at 10,000× magnification of a test panel showing a cobalt conversion coating 610 of the invention. The photomicrograph is a top view of the upper surface of oxide coating 610. The top of oxide coating 610 is porous and has a sponge-like appearance as shown in FIG. 1. This test panel was immersed in the cobalt conversion coating solution for 30 minutes. The white bar is a length of 1 $\mu$m (1 micrometer).

FIG. 2 is a photomicrograph at 20,000× magnification of a test panel showing a cobalt conversion coating 610 of the invention. The photomicrograph is a top view of the upper surface of oxide coating 610. The white bar is a length of 1 $\mu$m (1 micrometer).

FIG. 3 is a photomicrograph at 50,000× magnification of a test panel showing a cobalt conversion coating 610 of the invention. The photomicrograph is a top view of the upper surface of oxide coating 610. The white bar is a length of 100 nm (100 nanometers).

FIG. 4 is a photomicrograph at 10,000× magnification of a test panel showing a side view of a fractured cross section of a cobalt conversion coating 620 of the invention. The fractured cross section of the aluminum alloy substrate of the test panel is indicated by reference numeral 622. To make the photomicrographs of FIGS. 4, 5, and 6, the test panel was bent and broken off to expose a cross section of oxide coating 620. The white bar is a length of 1 $\mu$m (1 micrometer).

FIG. 5 is a photomicrograph at 20,000× magnification of a test panel showing a side view of a fractured cross section of a cobalt conversion coating 620 of the invention. The white bar is a length of 1 $\mu$m (1 micrometer).

FIG. 6 is a photomicrograph at 50,000× magnification of a test panel showing a side view of a fractured cross section of a cobalt conversion coating 620 of the invention. The white bar is a length of 100 nm (100 nanometers).

BEST MODE FOR CARRYING OUT THE INVENTION

Figure 1:
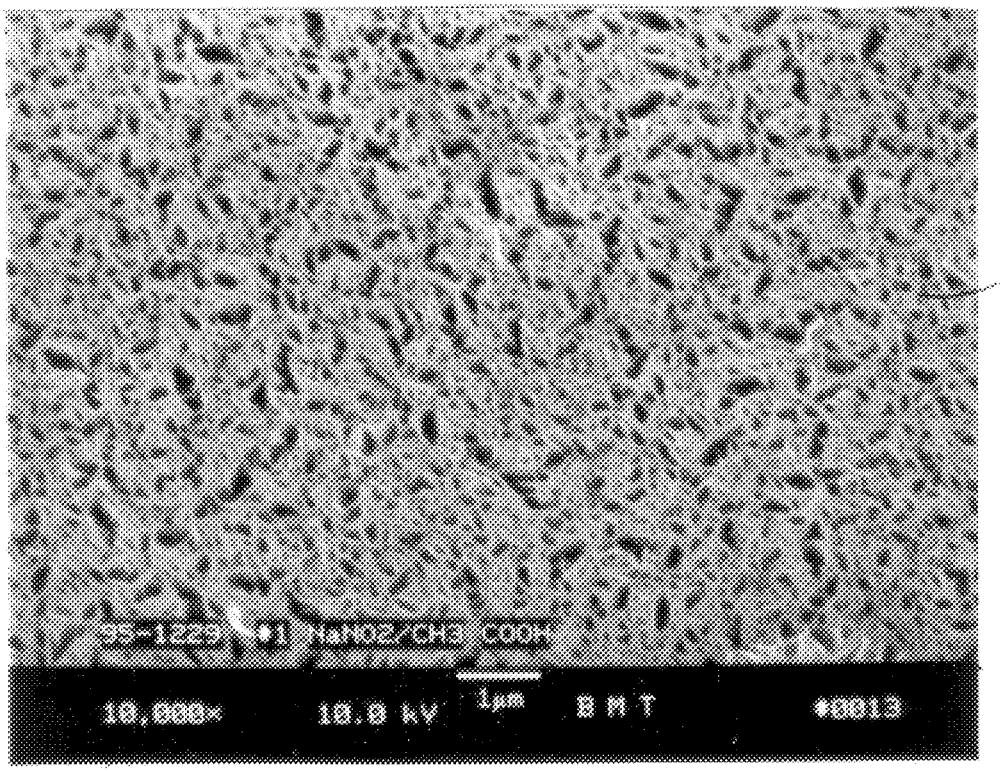
FIGS. 1–6 are photomicrographs (where the scanning electron microscope operated at 10 kV or 15 kV) of aluminum alloy 2024-T3 test panels having cobalt conversion coatings made by the invention and then given a post conversion treatment in a solution containing vanadium pentoxide and sodium tungstate (described below in Example 2).

The present invention is a further improvement over the processes described in earlier related patent applications, for example, U.S. Ser. No. 07/525,800 (application #1), filed May 17, 1990, now U.S. Pat. No. 5,298,092, issued Mar. 29, 1994; U.S. Ser. No. 08/058,655 (application #3A), filed May 6, 1993, now U.S. Pat. No. 5,378,293, issued Jan. 3, 1995; U.S. Ser. No. 07/903,853 (application #4), filed Jun. 25, 1992, now U.S. Pat. No. 5,411,606, issued May 2, 1995; and U.S. Ser. No. 08/287,690 (application #5), filed Aug. 9, 1994, now U.S. Pat. No. 5,551,994, issued Sep. 3, 1996.

In U.S. Ser. No. 08/287,690 (application #5), filed Aug. 9, 1994, now U.S. Pat. No. 5,551,994, issued Sep. 3, 1996, process improvements were described which use amines, such as triethanolamine (TEA), as a cobalt complexer and which deliver a high degree of bath stability and a high corrosion resistance performance exhibited by coated aluminum alloy substrates. The principle was to combine the cobalt complexers, such as sodium nitrite $NaNO_2$, or the acetates, such as $NaC_2H_3O_2$, $Mg(C_2H_3O_2)_2$, $Ca(C_2H_3O_2)_2$, or $NH_4C_2H_3O_2$, with the amine complexer to form mixed cobalt complex compounds. This process resulted in a coating having both a high degree of corrosion performance (336 hour salt spray test according to ASTM B117) and superb paint adhesion when tested according to Boeing Material Specifications BMS 10-11 and BMS 10-60. In particular, the nitrite-triethanolamine process was found to be a very robust system, where extraneous effects, such as choice of degreaser or deoxidizer for surface preparation, had little or no effect on coating performance. Unfortunately, nitrite/amine complexing has the possibility of the formation of nitrosamines. Nitrosamine compounds are known carcinogens and it would defeat the purpose to replace carcinogenic hexavalent chromium compounds with similarly hazardous compounds. Since cobalt conversion coating baths are operated at a pH of near neutral, the chances of forming nitrosamines are remote, but the possibility of long term formation of nitrosamines cannot easily be ascertained.

For that reason, and to avoid lengthy environmental review prior to production implementation, it was deemed necessary to continue research in order to find an alternative either for $NaNO_2$ or for triethanolamine (TEA). Finding a replacement for the $NaNO_2$ complexer has been unsuccessful. However, an alternative to the TEA has been discovered, tested, and scaled up. Accordingly, the present invention is a new process and bath, containing no triethanolamine (TEA), which yields coatings which are in all aspects performing equally to the earlier TEA process (described in application #5), but with the added advantages of even better bath stability and improved process efficiency.

Description Of The Improved Cobalt Chemical Conversion Processes

The present invention exhibits improvements with respect to the processes described in the earlier related patent applications above: Ser. No. 07/525,800 (patent application #1), Ser. No. 07/621,132 (patent application #2), Ser. No. 07/732,568 (patent application #3), and Ser. No. 07/903,853 (patent application #4). The improvements are a higher bath stability and a higher corrosion resistance performance exhibited by coated aluminum alloy substrates. As a consequence of the higher bath stability, the bath life is longer.

Regarding the improved bath stability, the bath of the present invention has no detectable decay rate after six months of production use. The decay rate is measured by sludge formed in the bath. The bath of the present invention has no sludge in the bath after six months of production use. This is a significant improvement because the baths of the four earlier patent applications have detectable decay rates, they form sludge, and they have bath lives of 2 to 3 months in production use. Furthermore, the present bath performance effectiveness has not decreased in six months of production use. Another feature of the bath is that the constituents are replenishable. A six-month bath life is considered a minimum for a commercially practical service life in the aircraft/aerospace industry (for example, for treating aircraft parts). Thus, the present invention is a commercially practical process and a commercially practical bath.

Regarding the improved corrosion resistance performance, the present coated aluminum alloy substrates exhibit an increased level about three weeks of corrosion resistance when tested in a standard salt spray test, ASTM B117, while also exhibiting technically acceptable level of paint adhesion when tested in accordance with the tests specified in applicable paint specifications. This is a significant improvement because the best coated aluminum alloy substrates of the four earlier patent applications would exhibit 2 weeks of corrosion resistance in the salt spray test.

Chemistries

In U.S. Ser. No. 08/287,690 (application #5), filed Aug. 9, 1994, now U.S. Pat. No. 5,551,994, issued Sep. 3, 1996, the primary cobalt-III complex is believed to be:

(1) $Na_2[Co(NO_2)_3(TEA)]$ or $Na_2[Co(NO_2)_3(OCH_2CH_2)_3N)]$

It has now been discovered that a new complex (2), that contains formate ligands (derived from the water soluble organic acid, formic acid, or from a water soluble formate compound) instead of the ligands derived from TEA in the above complex (1), can be synthesized. Thus, this new complex is believed to have the formula shown in (2) below:

(2) $Na_3[Co(NO_2)_2(OOCH)_4]$

An important aspect of this chemistry is the fact that the cobalt ion forms "resonating bonds" with the formate ligands through the mechanism shown in (3) below:

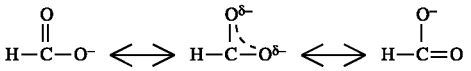

(3)

Equation (3) shows the typical electron dispersal between the two formate oxygens, known as electron resonance. It is this electron dispersal which is believed to account for the great stability of a solution containing complex (2).

It has also been discovered that another new complex (4), that contains acetate ligands (derived from glacial acetic acid) instead of the ligands derived from TEA in the above complex (2), can be synthesized. Thus, this new complex is believed to have the formula shown in (4) below:

(4) $Na_3[Co(NO_2)_2(OOCCH_3)_4]$

An important aspect of this chemistry is again the fact that the cobalt ion forms "resonating bonds" with the acetate ligands through the mechanism shown in (5) below:

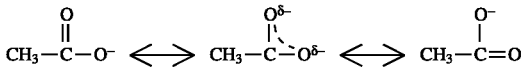

(5)

Equation (5) shows the typical electron dispersal between the two acetate oxygens, known as electron resonance. It is this electron dispersal which is again believed to account for the great stability of a solution containing complex (4).

Other water soluble organic acids, such as propionic acid, butyric acid, and citric acid, were also investigated, but without success. Metal acetates, such as Mg-acetate, Ca-acetate, and Na-acetate, also did not yield the desired bath stability.

The identities of all of the chemical constituents in the present improved process baths and their quantities are not known with scientific certainty because the baths are a mixture of many constituents and, at this time, qualitative and quantitative analyses of the mixture, which require a long time and are difficult to perform, have not been completed. Furthermore, at this time the chemical mechanism by which the improved solutions perform their function is not understood, but complexing with cobalt to form cobalt-III hexacoordinated structures is believed to occur as shown below.

Description Of The Improved Cobalt Chemical Conversion Processes

The present invention exhibits improvements with respect to the processes described in the first four related patent applications listed above: Ser. No. 07/525,800 (application #1), Ser. No. 07/621,132 (application #2), Ser. No. 07/732,568 (application #3), and Ser. No. 07/903,853 (application #4). The improvements are a higher bath stability and a higher corrosion resistance performance exhibited by coated aluminum alloy substrates. As a consequence of the higher bath stability, the bath life is longer.

Regarding the improved bath stability, the bath of the present invention has no detectable decay rate after six months of production use. The decay rate is measured by sludge formed in the bath. The bath of the present invention has no sludge in the bath after six months of production use. This is a significant improvement because the baths of the four earlier patent applications have detectable decay rates, they form sludge, and they have bath lives of 2 to 3 months in production use. Furthermore, the present bath performance effectiveness has not decreased in six months of production use. Another feature of the bath is that the constituents are replenishable. A six-month bath life is considered a minimum for a commercially practical service life in the aircraft/aerospace industry (for example, for treating aircraft parts). Thus, the present invention is a commercially practical process and a commercially practical bath.

Regarding the improved corrosion resistance performance, the present coated aluminum alloy substrates exhibit an increased level of about 3 weeks of corrosion resistance when tested in a standard salt spray test, ASTM B117, while also exhibiting technically acceptable level of paint adhesion when tested in accordance with the tests specified in applicable paint specifications. This is a significant improvement because the best coated aluminum alloy substrates of the first four patent applications would exhibit 2 weeks of corrosion resistance in the salt spray test. For aircraft/aerospace applications (for example, for treating aircraft parts), the goal is to produce conversion coatings exhibiting maximum corrosion resistance performance while maintaining acceptable levels of paint adhesion performance.

Chemical Reactant Selection (Starting Materials)

The most critical parameters affecting performance of the present cobalt conversion coatings with respect to paint adhesion and corrosion resistance were found to be selection of the reactants and their concentrations in solution. It was found that coating performance was affected foremost by these factors rather than bath temperature or immersion time, although temperature and immersion time do impart their effects over larger variations of these parameters.

It is known that with respect to surface treatments of aluminum, paint adhesion and corrosion resistance are divergent properties. In other words, maximizing paint adhesion usually occurs at the expense of corrosion performance and vice-versa. This surface treatment behavior was also found to exist with cobalt conversion coatings.

Regarding reactant selection, a wide variety of water soluble cobalt salts are operable for cobalt complexing. Among the cobalt-II salts that are operable in water solution are $CoX_2$ where X is one or more selected from the group consisting of Cl, Br, $NO_3$, CN, SCN, $\frac{1}{3}PO_4$, $\frac{1}{2}SO_4$, $C_2H_3O_2$, or $\frac{1}{2}CO_3$. From an environmental standpoint, the cyanide and thiocyanate salts are not preferred. Furthermore, other cobalt-II salts may be used if they possess a minimum solubility in water. The most preferred cobalt-II salt is cobalt nitrate.

For conversion coatings to be used in aircraft/aerospace applications, a water soluble ammonium salt is a necessary starting material. The preferred ammonium salt is ammonium nitrate, since cobalt salts tend to have a strong reaction affinity for nitrates.

A water soluble inorganic complexing agent is also a necessary starting material. The preferred inorganic complexing agent is a metal nitrite salt $MeNO_2$, where Me is one or more selected from the group consisting of Na, K, or Li. The most preferred metal nitrite salt is sodium nitrite.

A water soluble organic complexing agent is also a necessary starting material. The organic complexing agent may be either acetic acid, formic acid, ammonium formate, or a metal formate, such as sodium formate or potassium formate. The most preferred organic complexing agent is formic acid.

A water soluble oxidizing agent is also a necessary starting material. The oxidizing agent may be selected from air oxygen, hydrogen peroxide $H_2O_2$, or both. The function of the oxidizing agent is to oxidize the cobalt-II ions in solution to cobalt-III ions. The stream of air flowing into the tank also functions as an oxidizer, but the hydrogen peroxide increases the rate of oxidation of the cobalt-II ions in solution to cobalt-III ions and therefore is useful for commercial practice of the invention in that the solution becomes operational in a shorter period of time.

As discussed above, the improved aqueous reaction solution or conversion bath, containing no triethanolamine (TEA), is a system wherein it is necessary to have all of the chemical constituents that result from the chemical reactions involving the starting materials. The resultant aqueous reaction solution containing many chemical constituents is needed in order to form technically acceptable oxide coatings.

To summarize, the necessary starting materials are the following:

1. A water soluble cobalt-II salt.
2. A water soluble ammonium salt.
3. A water soluble inorganic complexing agent (metal nitrites are preferred).
4. A water soluble organic complexing agent (formic acid and formates are preferred).
5. A water soluble oxidizing agent (such as $H_2O_2$ and/or air oxygen).

Chemical Concentrations, pH Control, Temperature, And Immersion Time

With respect to chemical concentrations, the concentration of dissolved cobalt-II salt used may be from about 0.01 mole per liter of solution to the saturation limit of the cobalt-II salt employed at 20° C. (68° F.). Preferably, the concentration of dissolved cobalt-II salt used may be from about 0.089 mole per liter of solution to about 0.1 mole per liter of solution.

The concentration of the dissolved ammonium salt may be from about 0.03 to 2.5 moles per liter of solution. Preferably, the concentration of dissolved ammonium salt used may be from about 0.62 mole per liter of solution to 0.69 mole per liter of solution.

The concentration of the dissolved inorganic complexing agent may be from about 0.03 to 2.5 moles per liter of solution. Preferably, the concentration of dissolved inorganic complexing agent may be from about 0.174 mole per liter of solution to 0.232 mole per liter of solution.

The concentration of dissolved organic complexing agent may be from about 0.30 to 1.85 moles per liter of solution. Preferably, the concentration of dissolved organic complexing agent may be from about 0.4 mole per liter of solution to 0.8 mole per liter of solution.

The amount of ammonium hydroxide (ammonia solution) added is a function of obtaining and maintaining the desired pH range, below.

The amount of oxidizing agent added may be from about 0.4 to 0.6 mole per liter of solution.

The pH of the bath may be from about 6.5 to 7.1, with 6.8 to 7.0 being preferred. The temperature of the bath may be from about 68° F. to 160° F., but prolonged heating above about 160° F. causes gradual decomposition of the cobalt-III hexacoordinated complex. The optimum temperature is 140°±5° F. The immersion time may be from about 3 minutes to 60 minutes with the optimum immersion time at 15–30 minutes.

Examples Of The Improved Processes Containing No Triethanolamine (TEA)

1. Glacial Acetic Acid Bath Make-Up Sequence

It is important that the following bath make-up sequence be followed exactly in order to obtain consistent process results:

(1) Fill a tank (having an inert liner, such as neoprene) to ⅔ full with deionized or distilled water. Begin air sparging to a gentle roll.

(2) Add and dissolve the required chemicals in the following order:
  (a) ammonium nitrate
  (b) glacial acetic acid
  (c) cobalt nitrate
  (d) hydrogen peroxide 30 wt %

(3) Let the solution react 10 to 15 minutes, then add the required amount of sodium nitrite.

(4) Let the solution react at 100° F. for an additional 20–30 minutes (5) Now add the required amount of ammonium hydroxide (ammonia solution) to bring the bath pH to 6.8 (preferred pH). This will require at least the equivalent amount of $NH_4OH$ to neutralize the acetic acid. Usually an excess of 25–50 ml/l $NH_4OH$ will be needed.

(6) Check the pH. If the pH is still below 6.8, add the required amount of $NH_4OH$ to the solution until pH 6.8 is reached. Do not exceed pH 7.0 because loose, powdery coatings will result.

(7) Add an additional 5–15 ml/l of $H_2O_2$ 30 wt % to complete the reaction.

(8) Heat the tank to 140° F. and maintain. The solution is now ready for operation.

Example 1 represents a preferred example of the improved process that uses glacial acetic acid as shown below:

EXAMPLE 1

| COMPONENT | MAKE-UP PER LITER | CONTROL PER LITER |
|---|---|---|
| Ammonium nitrate $NH_4NO_3$ | 53 gm/l (0.66 mole/liter) | 50–55 gm/l (0.62–0.69 mole/liter) |
| Glacial acetic acid $CH_3COOH$ | 40 ml/l (0.7 mole/liter) | 38–45 ml/l (0.66–0.79 mole/liter) |
| Cobalt nitrate (hexahydrate) $Co(NO_3)_2.6H_2O$ | 26 gm/l (0.089 mole/liter) | 24–29 gm/l (0.082–0.10 mole/liter) |
| Hydrogen peroxide $H_2O_2$ 30 wt % | 20 ml/l (0.176 mole/liter) | — |
| Sodium nitrite $NaNO_2$ | 13 gm/l (0.188 mole/liter) | 12–16 gm/l (0.174–0.232 mole/liter) |
| Ammonium hydroxide $NH_4OH$ | 55 ml/l (0.42 mole/liter) minimum | As required to maintain pH |
| Hydrogen peroxide $H_2O_2$ 30 wt % | 5 ml/l (0.044 mole/liter) to complete reaction | — |
| Water (deionized) | Balance | As required |
| pH | 6.8 | 6.6–7.0 |
| Temperature | 100° F. ± 5° F. on make-up | 140° F. ± 5° F. operating |
| Immersion time | — | 15–30 minutes |

When acetic acid is a starting material, Example 1 above represents chemical quantities which yield optimum processing results, however coating formation is not limited to these parameters.

2. Post-Conversion Treatment Solution

Coatings made according to Example 1 are preferably subsequently treated with a post-treatment solution that contributes further to the improved corrosion resistance performance of the cobalt conversion coatings. Example 2 below is a preferred formulation for the post-conversion coat treatment.

EXAMPLE 2

| COMPONENT | MAKE-UP PER LITER | CONTROL PER LITER |
|---|---|---|
| Vanadium pentoxide $V_2O_5$ (preferred) | 2 gm (0.011 mole/liter) | 1.5–3.0 gm (0.0082–0.016 mole/liter) |
| Sodium tungstate $Na_2WO_4.2H_20$ | 8 gm (0.024 mole/liter) | 6.5–10.0 gm (0.020–0.030 mole/liter) |
| Temperature | 140° F. | 140° F. |
| Immersion time | — | 3–5 minutes |
| pH | — | 6.8–7.2 |

3. Formic Acid Bath Make-Up Sequence

As stated previously, it has also been discovered that a new complex (2) above that contains formate ligands, instead of the ligands derived from TEA in complex (1) above, can be synthesized. As also stated previously, the most preferred organic complexing agent is formic acid. It is important that the following formic acid bath make-up sequence be followed exactly in order to obtain consistent process results:

(1) Fill a tank (having an inert liner, such as neoprene) to ¾ full with deionized or distilled water. Begin air sparging to a gentle roll.

(2) Add and dissolve the required chemicals in the following order:
- (a) ammonium nitrate
- (b) cobalt nitrate
- (c) formic acid
- (d) ammonium hydroxide to reach pH 7.0–7.1
- (e) sodium nitrite
- (f) hydrogen peroxide.

(3) Let the solution react at 140° F. for an additional 30 to 90 minutes.

(4) Check the pH. If the pH is below 6.5, then add the required amount of ammonium hydroxide slowly to the solution while agitating vigorously, until the desired pH range is reached.

(5) The solution is now ready for operation.

Example 3 below represents a preferred example of an improved process that uses formic acid as shown below:

EXAMPLE 3

(MOST PREFERRED)

| COMPONENT | MAKE-UP PER LITER | CONTROL PER LITER |
|---|---|---|
| Ammonium nitrate $NH_4NO_3$ | 55 gm/liter (0.69 mole/liter) | 52–58 gm/liter (0.65–0.73 mole/liter) |
| Cobalt nitrate (hexahydrate) $Co(NO_3)_2.6H_2O$ | 26 gm/liter (0.089 mole/liter) | 24–29 gm/liter (0.082–0.10 mole/liter) |
| Sodium nitrite $NaNO_2$ | 13 gm/liter (0.19 mole/liter) | 12–16 gm/liter (0.17–0.24 mole/liter) |
| Formic acid HCOOH | 26.4 ml/liter (0.62 moles/liter) | — |
| Ammonium hydroxide $NH_4OH$ | 40 ml/liter (0.30 moles/liter) | As required to maintain pH |
| Hydrogen peroxide $H_2O_2$ 30 wt % | 2.6–5.2 ml/liter (0.023–0.046 moles/liter) | — |
| Water (deionized) | Balance | As required |
| Temperature | 140° F. | 135–145° F. |
| pH | 7.0 | 6.8–7.1 |
| Immersion time | — | 15–30 minutes |

Coatings made according to Example 3 are preferably subsequently treated with a post-treatment solution that contributes further to the improved corrosion resistance performance of the cobalt conversion coatings. Example 2, above, is a preferred formulation for the post-conversion coat treatment.

When formic acid is a starting material, Example 3 above represents chemical quantities which yield optimum processing results, however coating formation is not limited to these parameters. A way to prepare and maintain an alternative ammonium formate bath solution is as follows.

4. Alternative Ammonium Formate Bath Make-Up Sequence

It is important that the following bath make-up sequence be followed exactly in order to obtain consistent process results:

(1) Fill a tank (having an inert liner, such as Neoprene) to ¾ full with deionized or distilled water. Begin air sparging to a gentle roll.

(2) Add and dissolve the required chemicals in the following order:
- (a) ammonium nitrate
- (b) cobalt nitrate
- (c) ammonium formate
- (d) ammonium hydroxide to reach pH 7.0–7.1
- (e) hydrogen peroxide.

(3) Let the solution react for 5 to 10 minutes. The solution will change color to yellow/brown, with some gassing. A mild ammonia smell will be noticeable.

(4) Let the solution react at 140° F. for an additional 30 to 90 minutes.

(5) Check the pH. If the pH is below 6.8, then add the required amount of ammonium hydroxide slowly to the solution while agitating vigorously, until the desired pH range is reached.

(6) The solution is now ready for operation.

Example 4 represents an example of an alternative process that uses ammonium formate as shown below:

EXAMPLE 4

| COMPONENT | MAKE-UP PER LITER | CONTROL PER LITER |
|---|---|---|
| Ammonium nitrate $NH_4NO_3$ | 55 gm/liter (0.69 mole/liter) | 52–58 gm/liter (0.65–0.73 mole/liter) |
| Cobalt nitrate (hexahydrate) $Co(NO_3)_2.6H_2O$ | 26 gm/liter (0.089 mole/liter) | 24–29 gm/liter (0.082–0.10 mole/liter) |
| Ammonium formate $NH_4COOH$ | 26.4 gm/liter (0.42 mole/liter) | 24–29 gm/liter (0.38–0.46 mole/liter) |
| Ammonium hydroxide $NH_4OH$ | 26.4 ml/liter (0.20 mole/liter) | As required to maintain pH |
| Sodium nitrite $NaNO_2$ | 13 gm/liter (0.188 mole/liter) | — |
| Hydrogen peroxide $H_2O_2$ 30 wt % | 2.6–5.2 ml/liter (0.023–0.046 mole/liter) | — |
| Water (deionized) | Balance | As required |
| Temperature | 140° F. | 135–145° F. |
| pH | 7.0–7.1 | 6.5–7.1 |
| Immersion time | — | 15–30 minutes |

Coatings made according to Example 4 are preferably subsequently treated with a post-treatment solution that contributes further to the improved corrosion resistance performance of the cobalt conversion coatings. Example 2 above is a preferred formulation for the post-conversion coat treatment.

Surface Structure And Coating Thickness

Scanning Electron Microscope (SEM) analysis was carried out using magnifications ranging from 10,000× to 50,000×. The photomicrographs (FIGS. 1–6) depict a highly porous surface oxide (as seen in top views FIGS. 1–3) with a rigid columnar structure (as seen in side views FIGS. 4–6). This structure could physically be compared to a honeycomb cell structure where the individual cell openings have been deformed to no longer show symmetrical hexagonal shapes, but rather randomly deformed pore openings. Coating thickness is typically from 120 nanometers to 300 nanometers depending on the length of time of substrate immersion in the chemical conversion bath. Typical coatings of 140–150 nanometers are formed within 10–15 minutes immersion time at 140° F. bath temperature while coatings of 280–300 nanometers require 30–45 minutes immersion time to develop. Thick coatings are not preferred, however, due to the formation of powdery deposits when extended beyond a thickness of about 200 nanometers.

Preferred Cobalt Conversion Coating Process Flow

The preferred cobalt conversion coating process flow sequence may be summarized as follows:

(1) PRECLEAN IF REQUIRED
(2) MASK AND RACK AS REQUIRED
(3) ALKALINE CLEAN AND RINSE
(4) DEOXIDIZE AND RINSE
(5) FORM COBALT CONVERSION COATING
(6) IMMERSION RINSE
(7) POST CONVERSION TREATMENT STEP
(8) RINSE
(9) DRY

General Notes With Respect To The Above Process Flow

The cobalt conversion coating should be applied after all trimming and fabrication have been completed. Parts, where solution entrapment is possible, should not be subjected to immersion alkaline cleaning or immersion deoxidizing; manual cleaning and manual deoxidizing procedures should be used to obtain water break-free surfaces before applying cobalt conversion treatment. A water break-free surface is a surface which maintains a continuous water film for a period of at least 30 seconds after having been sprayed or immersion rinsed in clean water at a temperature below 100° F.

Thorough rinsing and draining throughout processing are necessary as each solution should be completely removed to avoid interference with the performance of the next solution in the sequence. Parts should be processed from one step to the next without delay and without allowing the parts to dry. When it is necessary to handle wet parts, wear clean latex rubber gloves. After conversion coating, handle dry parts only with clean fabric gloves. For processing systems that require part clamping, the number and size of contact points should be kept to a minimum as necessary for adequate mechanical support.

Precleaning

Vapor degrease may be performed in accordance with Boeing Process Specification BAC 5408, emulsion clean in accordance with Boeing Process Specification BAC 5763, or solvent clean in accordance with Boeing Process Specification BAC 5750 if parts are greasy or oily. Parts with open faying surfaces or spot-welded joints where solution entrapment is possible should be immersed in cold water (or in hot and cold water) for 2 minutes after precleaning.

Masking And Racking

Areas that do not require cobalt conversion coatings should be masked with maskants. Dissimilar metal inserts (except chromium, nickel or cobalt alloy or plating, CRES, or titanium) and non-aluminum coated plasma flame sprayed area should be masked off.

Alkaline Cleaning

Alkaline clean and rinse may be performed in accordance with Boeing Process Specification BAC 5744 or BAC 5749, except for parts with open faying surfaces or spot welded joints, in which case, rinsing should be for at least 10 minutes using agitation with multiple immersions (a minimum of four times) followed by manual spray rinsing as required to prevent solution entrapment.

Deoxidizing

Deoxidize and rinse may be performed in accordance with Boeing Process Specification BAC 5765 except for parts where solution entrapment is possible, which parts may be rinsed using the method described above under "Alkaline Cleaning." Castings may be deoxidized by either of the following methods:

a. Deoxidize in accordance with Boeing Process Specification BAC 5765, Solution 37, 38 or 39.

b. Dry abrasive blast castings in accordance with Boeing Process Specification BAC 5748, Type II, Class 1 and rinse.

Other Methods Of Application

The above formulations illustrate producing cobalt conversion coatings by immersion application. The same principles apply to producing the conversion coating by manual application and by spray application.

Oxide Coating Analyses

ESCA surface analysis, using a Perkin-Elmer Model 550 surface analyzer, and Auger oxide profiles, using the same machine (in a different operating mode), have been performed in order to characterize the cobalt conversion coatings of the invention. (ESCA=electron spectroscopy for chemical analysis (also known as XPS or X-ray photoelectron spectroscopy).) These analyses show that the cobalt conversion coating consists of a mixture of oxides, namely, aluminum oxide $Al_2O_3$ as the largest volume percent, and cobalt oxides CoO, $Co_3O_4$, and $Co_2O_3$. The term "largest volume percent" means that the volume of this oxide exceeds the volume of any other oxide which is present, but the term "largest volume percent" does not necessarily imply that the volume of this oxide is more than 50 volume percent.

The data further shows that in the lower portion of the oxide coating (that is, next to the aluminum substrate), the largest volume percent is $Al_2O_3$. The middle portion of the oxide coating is a mixture of CoO, $Co_3O_4$, and $Al_2O_3$. And the data shows that in the top portion of the oxide coating, the largest volume percent is a mixture of $Co_3O_4$ and $Co_2O_3$.

Figure 2:
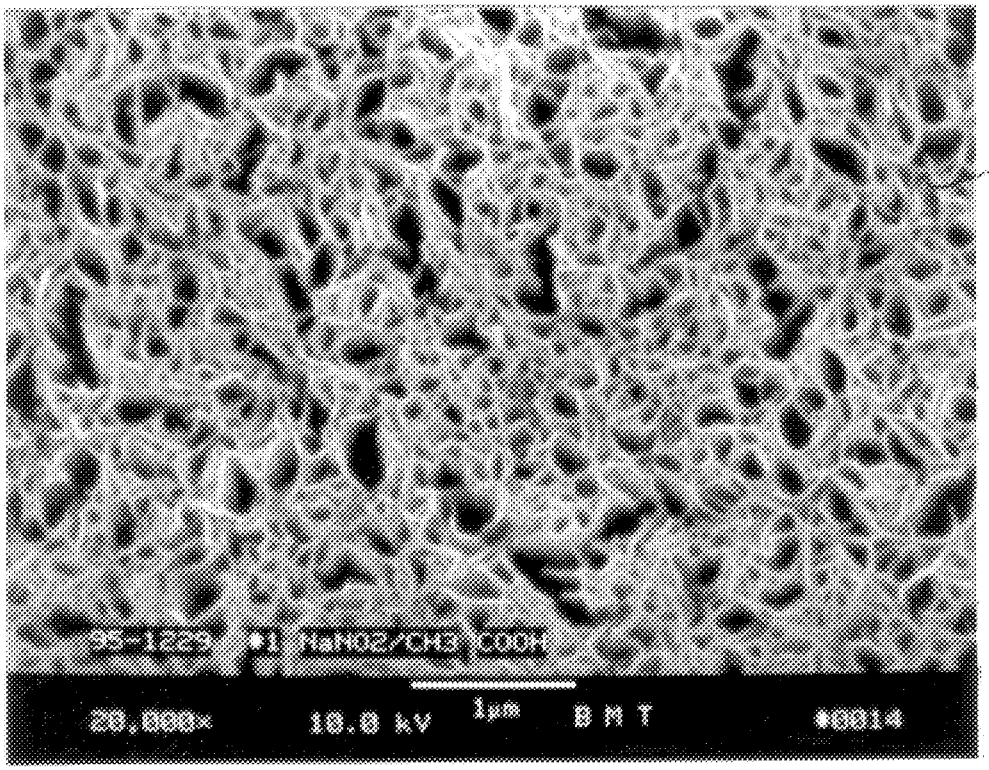
Figure 3:
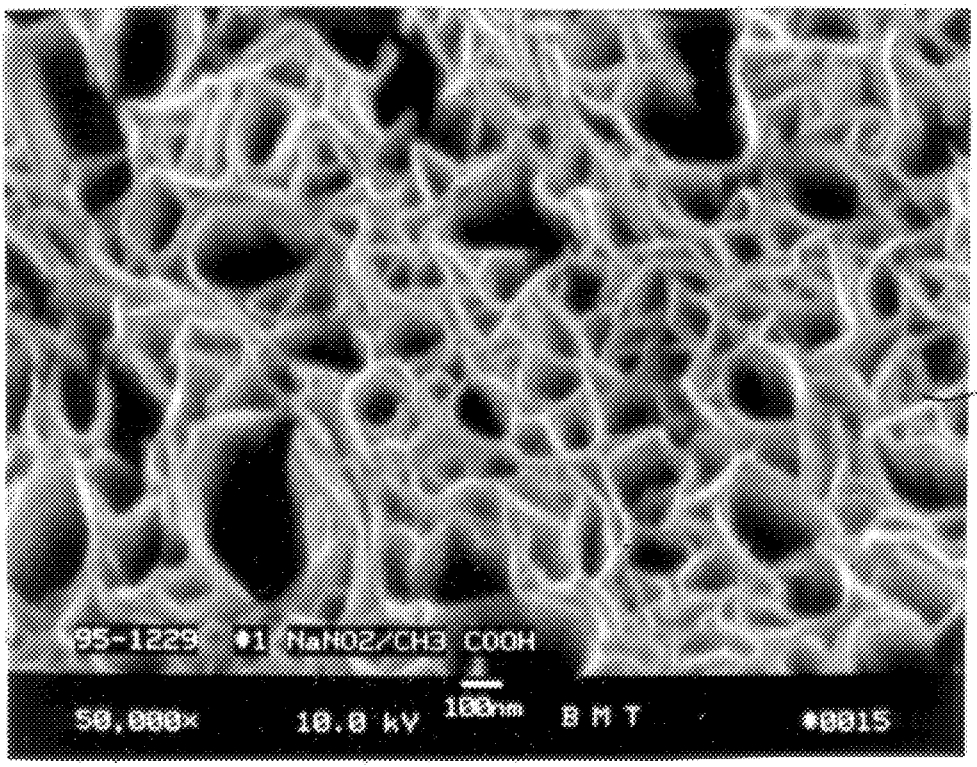
Figure 4:
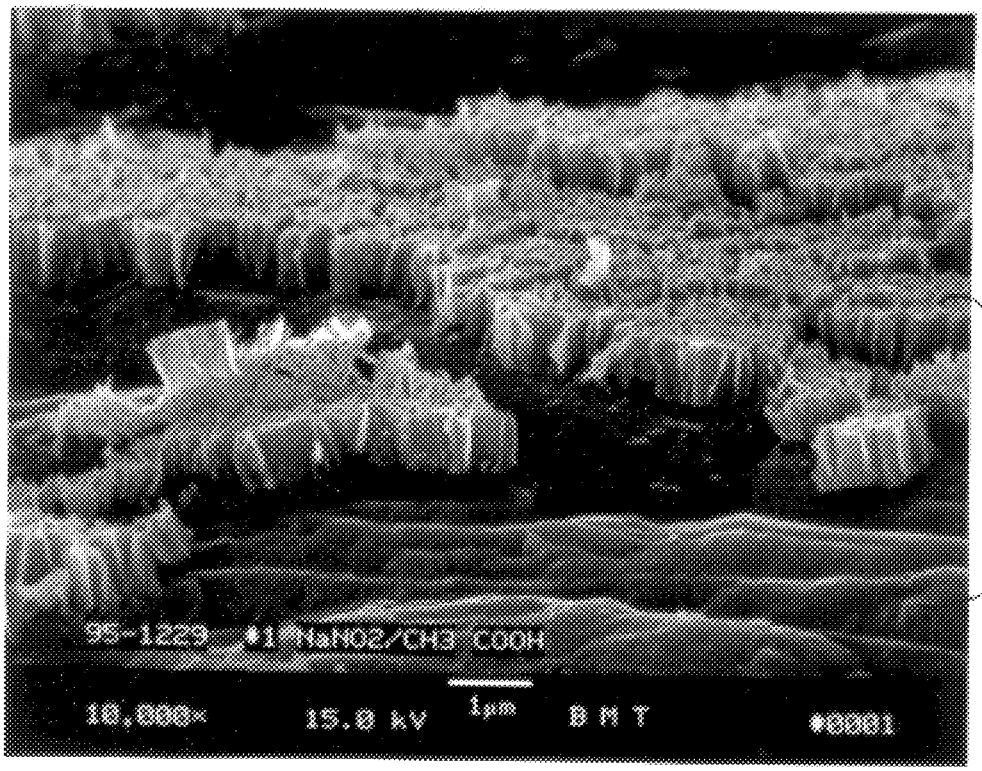
Figure 5:
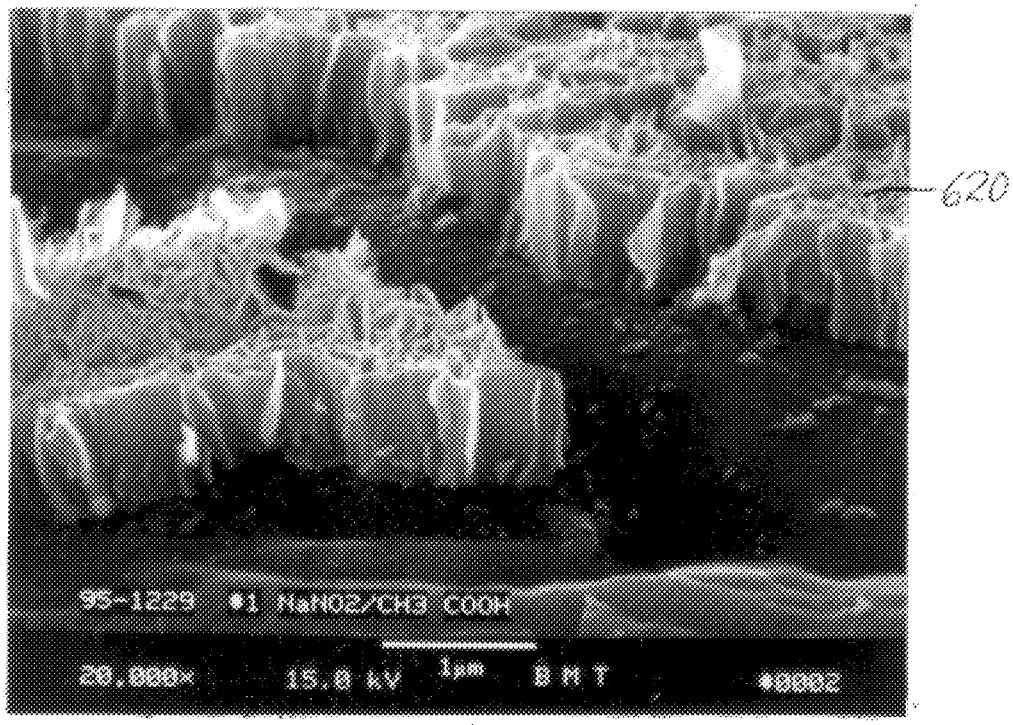
Figure 6:
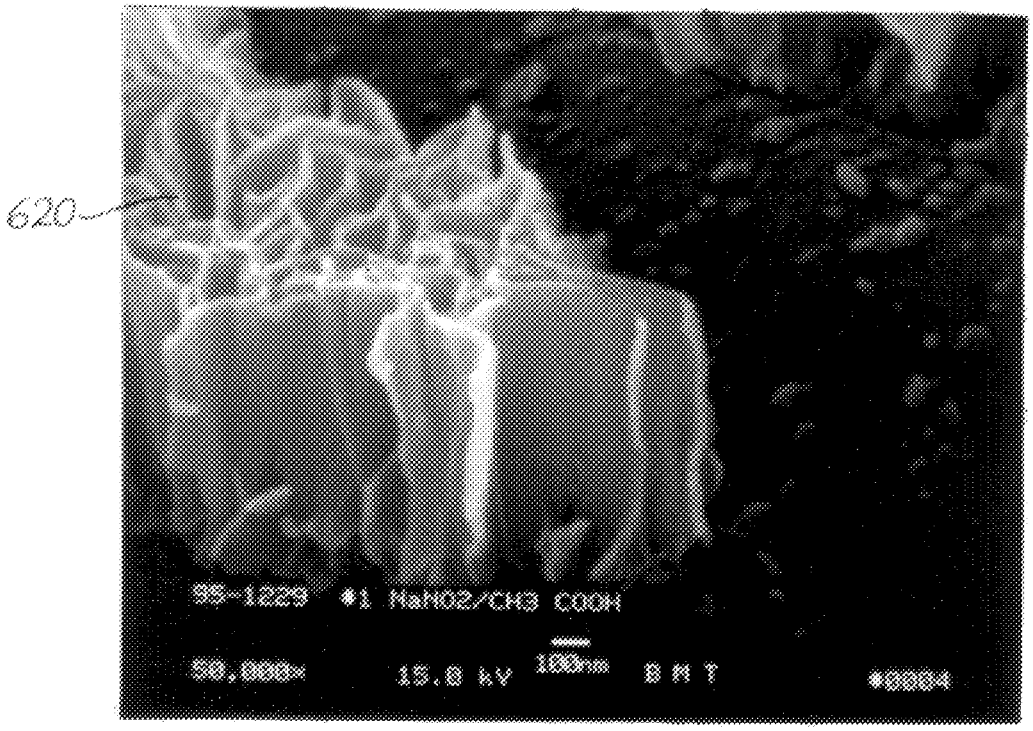

Additional characterization and morphology of the cobalt conversion coatings of the invention may be found in the photomicrographs FIGS. 1–6 and in the descriptions of the photomicrographs above. Top views FIGS. 1–3 show a cobalt conversion coating 610 formed by a 30 minute immersion in a typical cobalt conversion coating solution. Side views FIGS. 4–6 show a cobalt conversion coating 620 formed by a 30 minute immersion in a typical cobalt conversion coating solution.

The patents, specifications, and other publications referenced above are incorporated herein by reference.

Unless indicated otherwise, in stating a numerical range for a compound or a temperature or a time or other process matter or property, such a range is intended to specifically designate and disclose the minimum and the maximum for the range and each number, including each fraction and/or decimal, between the stated minimum and maximum for the range. For example, a range of 1 to 10 discloses 1.0, 1.1, 1.2 . . . 2.0, 2.1, 2.2, . . . and so on, up to 10.0. Similarly, a range of 500 to 1000 discloses 500, 501, 502, . . . and so on, up to 1000, including every number and fraction or decimal therewithin. "Up to x" means "x" and every number less than "x," for example, "up to 5" discloses 0.1, 0.2, 0.3, . . . , and so on up to 5.0.

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative and not restrictive. The scope of the present invention is as set forth in the appended claims rather than being limited to the examples set forth in the foregoing description. Any and all equivalents are intended to be embraced by the claims.

What is claimed is:

1. An improved process that is commercially practical for forming an oxide film cobalt conversion coating exhibiting corrosion resistance and paint adhesion properties on a substrate, wherein said substrate is aluminum or aluminum alloy, said process comprising the steps of:

(a) providing an oxide film forming cobalt conversion solution comprising an aqueous reaction solution, containing no triethanolamine (TEA), prepared by reacting the following starting materials:

(1) a water soluble cobalt-II salt wherein said water soluble cobalt-II salt is $CoX_2$ where X=Cl, Br, $NO_3$, CN, SCN, ⅓$PO_4$, ½$SO_4$, $C_2H_3O_2$, or ½$CO_3$;

(2) a water soluble ammonium salt;

(3) a water soluble inorganic complexing agent selected from the group consisting of water soluble metal nitrites wherein said water soluble metal nitrite is $MeNO_2$, where Me is one or more selected from the group consisting of Na, K, or Li;

(4) a water soluble organic complexing agent selected from the group consisting of acetic acid, formic acid, ammonium formate, or a water soluble metal formate; and (5) a water soluble oxidizing agent wherein said oxidizing agent is selected from the group consisting of air oxygen, hydrogen peroxide $H_2O_2$, or both air oxygen and hydrogen peroxide $H_2O_2$; and (b) contacting said substrate with said aqueous reaction solution for a sufficient amount of time to oxidize the surface of said substrate, whereby said oxide film cobalt conversion coating is formed, thereby imparting corrosion resistance and paint adhesion properties to said substrate.

2. The process of claim 1 wherein said water soluble cobalt-II salt is cobalt nitrate.

3. The process of claim 1 wherein said water soluble ammonium salt is ammonium nitrate.

4. The process of claim 1 wherein said water soluble metal nitrite is sodium nitrite.

5. The process of claim 1 wherein said water soluble organic complexing agent is formic acid.

6. The process of claim 1 wherein said oxidizing agent is hydrogen peroxide $H_2O_2$.

7. The process of claim 1 comprising the additional step of contacting said coated substrate with an aqueous post conversion treatment solution comprising a solution of vanadium pentoxide and sodium tungstate.

8. A chemical conversion coating solution that is commercially practical for producing an oxide film cobalt conversion coating on a metal substrate, said solution comprising an aqueous reaction solution, containing no triethanolamine (TEA), prepared by reacting the following starting materials:

(1) a water soluble cobalt-II salt wherein said water soluble cobalt-II salt is $CoX_2$ where X=Cl, Br, $NO_3$, CN, SCN, ⅓$PO_4$, ½$SO_4$, $C_2H_3O_2$, or ½$CO_3$;

(2) a water soluble ammonium salt;

(3) a water soluble inorganic complexing agent selected from the group consisting of water soluble metal nitrites wherein said water soluble metal nitrite is $MeNO_2$, where Me is one or more selected from the group consisting of Na, K, or Li;

(4) a water soluble organic complexing agent selected from the group consisting of acetic acid, formic acid, ammonium formate, or a water soluble metal formate; and (5) a water soluble oxidizing agent wherein said oxidizing agent is selected from the group consisting of air oxygen, hydrogen peroxide $H_2O_2$, or both air oxygen and hydrogen peroxide $H_2O_2$.

9. The chemical conversion coating solution of claim 8 wherein said cobalt-II salt is cobalt nitrate.

10. The chemical conversion coating solution of claim 8 wherein said ammonium salt is wherein said water soluble ammonium salt is ammonium nitrate.

11. The process of claim 8 wherein said water soluble organic complexing agent is formic acid.

12. The process of claim 8 wherein said oxidizing agent is hydrogen peroxide $H_2O_2$.

* * * * *